United States Patent [19]

Murray

[11] 4,385,568

[45] May 31, 1983

[54] SOLID FUEL FURNACE

[75] Inventor: David Murray, Prince Edward Island, Canada

[73] Assignee: Kerr Controls Limited

[21] Appl. No.: 211,802

[22] Filed: Dec. 1, 1980

[51] Int. Cl.[3] ..... F23B 7/00

[52] U.S. Cl. ..... 110/234; 110/210; 110/211; 122/30

[58] Field of Search ..... 110/210, 211, 234; 122/15, 30

[56] References Cited

U.S. PATENT DOCUMENTS

| | | | |
|---|---|---|---|
| 377,551 | 2/1888 | Emerson | 110/234 X |
| 1,896,252 | 2/1933 | Sloan | 110/116 |
| 3,866,551 | 2/1975 | Sanga | 110/210 |
| 3,930,802 | 1/1976 | Beasley et al. | 110/211 X |
| 4,102,279 | 7/1978 | Groschl et al. | 110/234 |
| 4,309,965 | 1/1982 | Hill | 110/234 X |

*Primary Examiner*—Edward G. Favors

*Attorney, Agent, or Firm*—Dressler, Goldsmith, Shore, Sutker & Milnamow, Ltd.

[57] ABSTRACT

A solid fuel burning device having a combustion chamber and a heat exchange chamber. The two chambers are joined by a tunnel composed of refractory material through which hot flue gases pass from the combustion chamber to the heat exchange chamber, causing the tunnel walls to be heated to the point of incandescence. As the flue gases pass through the tunnel there is a substantial reduction in uncombusted material by pyrolysis. The tunnel has an outside wall adopted to transmit energy by radiation.

12 Claims, 4 Drawing Figures

SOLID FUEL FURNACE

This relates to improvements in solid fuel devices particularly wood burning furnaces.

BACKGROUND OF THE INVENTION

It has been recognized that a serious problem with wood burning furnaces is the effects of incomplete combustion. Incomplete combustion results in the emission of pollutants, the deposition of the products of the incomplete combustion on the various elements within the furnace and in failure to achieve peak efficiency. A number of proposals have been made to reduce the level of uncombusted materials given off by solid fuel burning devices including the use of secondary combustion chambers.

It has been discovered that by passing the flue gases containing the products of incomplete combustion through a tunnel the walls of which have been rendered incandescent by the passage of hot flue gases therethrough, a substantial increase in the pyrolysis of the flue gases occurs, thereby resulting in reduction of the level of uncombusted materials in the gases.

The device contemplated for carrying out this method utilized a straight tunnel having relatively thick walls composed of refractory material and connecting a combustion chamber to a heat exchanger base portion. Because the tunnel could not be less than a certain minimum length in order to provide adequate dwell time to complete pyrolysis, there resulted a furnace which was relatively large because of the necessary separation of these two chambers to accommodate the connecting tunnel. Such a device was also heavy due to the relatively thick walls of the tunnel.

BRIEF SUMMARY OF INVENTION

In apparatus according to the present invention, there is provided a tunnel which is positioned in the base of the heat exchange chamber. Such positioning of the tunnel reduces the spacing between the combustion chamber and the base of heat exchange chamber thereby reducing dimensions, amounts of materials and weight of the furnace. Moreover by positioning the tunnel in the base of the heat exchange chamber the heat exchanger located directly above receives heat not only from the gases passing through it but it also receives radiant energy directly from the tunnel walls.

The tunnel according to the invention has a folded construction which serves effectively to lengthen it to permit adequate dwell time by the gases, while at the same time reducing its overall length in the direction of the tunnel axis. This folded construction also causes the heated flue gases to impinge on the outsides of the tunnel walls thereby reducing the time required to bring the tunnel up to temperature during start-up.

It is a further feature of this invention that a single air source is used for providing air for effecting a draft and for providing air to the combustion chamber. Improved efficiency is achieved by preheating the air fed to the combustion chamber by passing it through a stainless steel conduit passing through the heat exchanger chamber prior to introduction into the combustion chamber.

In accordance with the present invention there is provided apparatus for combustion of flue gases comprising a tunnel adapted to conduct the flue gases containing combustible materials therethrough, said tunnel including at least one wall having inside and outside surfaces, said wall being adapted to transmit energy from the outside surface thereof by radiation.

In accordance with another aspect of the invention there is provided apparatus for burning solid materials comprising a combustion chamber, a heat exchange chamber and a tunnel connecting said combustion chamber to said heat exchange chamber, said tunnel being adapted to conduct flue gases from said combustion chamber to said heat exchange chamber, said tunnel including walls having inside and outside surfaces at least one said wall being adapted to transmit energy from the outside thereof by radiation.

This invention is particularly suitable for use in wood burning furnaces however the principle is applicable to achieve a greater degree of combustion in other devices for burning solids, such as incinerators.

In drawings which illustrate embodiments of the invention,

Figure 1:
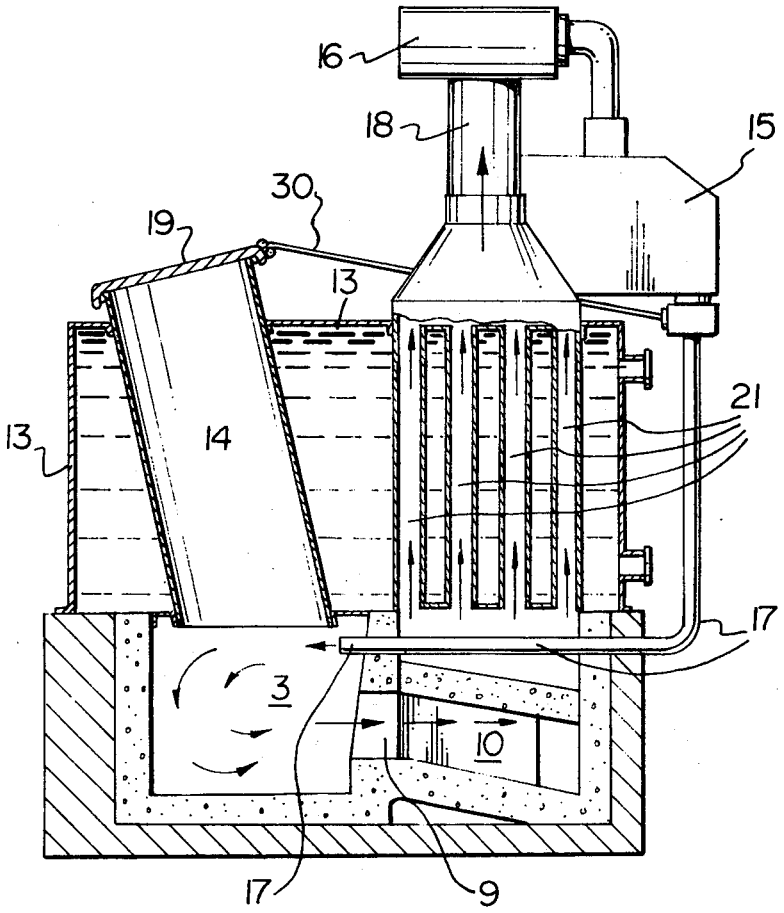
FIG. 1 is a side view partly in sections of a furnace incorporating a refractory base and tunnel in accordance with the present invention.

Referring to FIG. 1 there is illustrated a furnace having fuel chamber 14. The steel walls of the fuel chamber are surrounded by water contained in tank 13. The contact of the water with the outside walls of the fuel chamber serves to prevent the fuel chamber from becoming so hot as to cause combustion of the wood therein. The hinged cover 10 is adapted to open to permit access to the fuel chamber 14 for loading wood therein. A mechanical linkage 30 connects the fuel chamber cover 10 to the air source 15. A ball valve (not shown) in the air source 15 is operated by the linkage 30 and serves to cut off charge air to the furnace when the fuel chamber cover 10 is opened. Elimination of charge air when the cover 10 is opened prevents the discharge of sparks and smoke through the upper opening of the fuel chamber 14.

As combustion of the wood takes place in the combustion chamber 3, unburned wood from the supply in the wood chamber is continuously fed downward to the combustion chamber 3 by gravity.

Combustion chamber 3 is situated below the fuel chamber 14 and in direct communication with it. The combustion chamber 3 is supplied with air for combustion by air source 15 via air supply pipe 17. The air supply pipe 17 is composed of stainless steel and is adapted to withstand high temperatures while at the same time conducting heat from the outside to the air passing through it.

Figure 2:
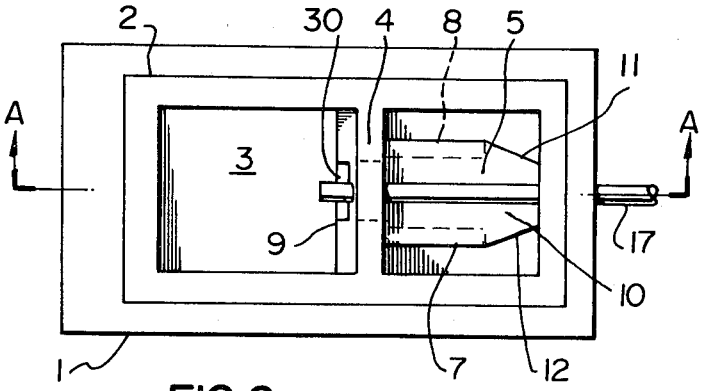
FIG. 2 is a plane view of the refractory base and tunnel in accordance with the present invention.
Figure 3:
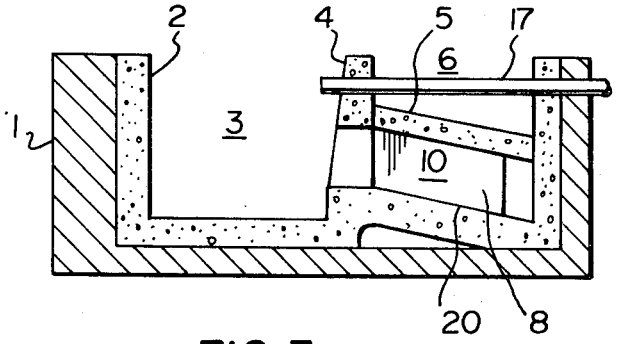
FIG. 3 is a section of the line AA of FIG. 2.
Figure 4:
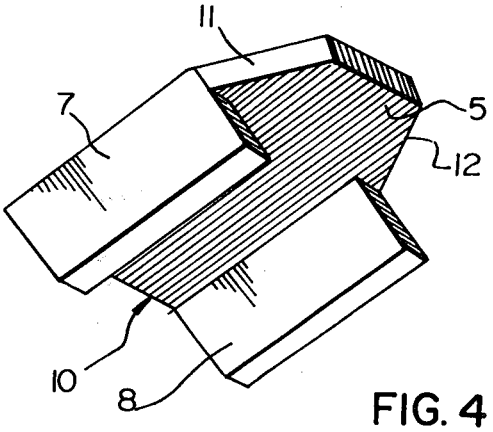
FIG. 4 is a perspective view of the upper portion of the tunnel shown in the previous Figures.

As will be seen from FIGS. 2 and 3, pipe 17 is located in the centre of the heat exchanger base above the tunnel. Thus the pipe 17 is subjected to the high temperature atmosphere of the heat exchanger chamber which causes heating of the air being fed through the pipe 17 to the combustion chamber.

Referring to FIGS. 2 and 3, the walls of the combustion chamber 3 are composed of castable refractory material and are lined with an insulating refractory material. The combustion chamber 3 is connected to the tunnel 10 via opening 9 in the wall 4. The main part of the tunnel 10 is bounded by sloping floor 20, vertical walls 7 and 8 and sloping top wall 5. The top and vertical walls of the tunnel are composed of castable refractory material and are preformed as a unit. The top wall 5 extends beyond the vertical walls 7 and 8 both laterally and in the direction of travel of the gases to effectively extend the tunnel. The top wall 5 is tapered by edges 11 and 12 at the gas exit end of the tunnel.

Heat exchangers 21 are located in the heat exchanger chamber above the tunnel and consist of vertically oriented tubes 21 through which the flue gases pass upwardly. The outside walls of the tubes 21 are surrounded by water and are adapted to conduct heat from the flue gases to the water. A forced draft inducer 16 which is fed by air from air source 15 assists movement of the flue gases through chimney 18.

In operation, fuel chamber 14 is loaded with wood which is fed by gravity into the combustion chamber 3. Air from the air source 15 is fed via pipe 17 through the heat exchange chamber where it is heated, to the orifice of pipe 17 in the combustion chamber to provide the necessary oxygen for combustion of the wood. The air is injected at a pressure of between 3 and 14 inches of water depending on the desired output, in the direction opposite to the direction of movement of the exiting gases. By injecting the air in such direction the necessary turbulence and high temperatures are produced to allow combustion to proceed at a very high rate. The movement of the injected air also serves to remove the ash from the combustion area, exposing the surface of the wood to the combustion process.

Since the period during which the combustion gases driven off from the burning wood remain in the combustion chamber is not sufficient to produce complete combustion thereof, the gases moving out of the combustion chamber 3 through opening 9 in wall 4 and into tunnel 10 may carry with them a substantial quantity of gaseous materials in relation to which complete combustion has not taken place. After a period of start up of the furnace, the hot gases passing through the tunnel 10 cause it to become incandescent. As gases continue to move through the tunnel 10, the high temperatures caused by the incandescent state of the tunnel produce additional combustion of uncombusted materials. The walls and the floor of the tunnel are maintained in an incandescent state by the gases passing through and the combustion that is taking place, in the tunnel. The degree of combustion which takes place in the tunnel is a function of the temperature of the entering gases, the temperature of the tunnel and the dwell time of the gases in the tunnel. The latter is a function of the pressure differential across the length of the tunnel and the tunnel dimensions. It has been found that satisfactory results are achieved using a heat exchange chamber base twelve inches wide in the direction of the tunnel axis and with tunnel temperatures in the range 1300° to 1800° F. and combustion chamber temperatures in the range of 1300° to 2100° F. The effective tunnel length will of course be greater than twelve inches (the width of the chamber base) by reason of the folded tunnel construction of the present invention.

As the gases move through the tunnel 10 and reach the end thereof they are no longer confined by walls 7 and 8, and tend to move laterally outward and upward. This movement causes the hot flue gases to contact the outside of side walls 7 and 8 and to some degree the outside to top wall 5. As a result, heat is transferred to the outsides of these walls. This serves to assist a more rapid heating of the tunnel walls to operating temperatures during start up. The incandescent state of the tunnel walls produces appreciable radiation of energy to the heat exchanger thus aiding the transferred energy to heat exchanger and the heating of the surrounding water.

After emerging from heat exchanger base chamber 6 the gases move upwardly through heat exchanger tubes 21 where heat from the gases is transferred via the walls of the tubes 21, to water stored in the surrounding tank. The heated water may be used for various purposes.

Movement of the gases up through chimney 18 is assisted by means draft device 16 to which air is supplied by air source 15.

What I claim as my invention is:

1. Apparatus for burning solid materials comprising a combustion chamber; a fuel chamber situated above said combustion chamber and communicating therewith by way of an opening in the top of said combustion chamber; a heat exchange chamber situated laterally of said combustion chamber, said heat exchange chamber including a heat exchange means; (and) a tunnel connecting said combustion chamber to said heat exchange chamber, said tunnel being adapted to conduct flue gases from said combustion chamber to said heat exchange chamber, said tunnel being adapted to cause secondary combustion in said gases during passage therethrough, said tunnel including walls having inside and outside surfaces, at least a portion of said passage being situated in said heat exchange chamber; at least one said wall being adapted to transmit energy from the outside thereof to said heat exchange means, by radiation.

2. Apparatus according to claim 1 wherein said walls of said tunnel are composed of a refractory material.

3. Apparatus according to claim 2 including a wall between said heat exchange chamber and said combustion chamber having an opening therein, said tunnel being in communication with said opening in said wall between said heat exchange chamber and said combustion chamber, said walls of said tunnel being adapted to become incandescent during operation thereby providing a high temperature atmosphere within said tunnel to cause continued combustion of the flue gases therein.

4. Apparatus according to claim 1, 2 or 3 including means for directing flue gases emerging from said tunnel against at least one of said outside wall surfaces.

5. Apparatus according to claim 2 wherein said tunnel includes an exit which is oriented so as to cooperate with said heat exchange chamber wall surface to direct flue gases emerging from said exit into contact with the outside surfaces of said tunnel walls.

6. Apparatus according to claim 2 including means for supplying air above atmospheric pressure to said combustion chamber.

7. Apparatus according to claim 1, 2 or 3 including an air supply source, said air supply source being adapted to supply air to a draft device and to supply air through a pipe passing through the heat exchange chamber to the combustion chamber thereby providing preheated air to the combustion chamber.

8. Apparatus according to claim 1, 2 or 3 wherein the dimensions of said tunnel and the pressure differential along the length of said tunnel, permit the flue gases to dwell in the tunnel for a sufficient period of time to effect additional combustion of uncombusted materials therein.

9. Apparatus according to claim 1 wherein said tunnel is positioned below said heat exchanger in said heat exchange chamber.

10. Apparatus according to claim 1, 2 or 3 including a draft means for assisting movement of said flue gases.

11. Apparatus according to claim 1 or 2 wherein said tunnel slants downward in the direction of travel of said flue gases.

12. Apparatus according to claim 1 or 2 wherein said fuel chamber is surrounded by water.

* * * * *